US006139911A

United States Patent [19]

Vanhecke et al.

[11] Patent Number: 6,139,911

[45] **Date of Patent: *Oct. 31, 2000**

[54] RELEASE AGENT FOR ROLLS AND METHOD FOR IMPROVING RELEASE PROPERTIES OF ROLLS

[75] Inventors: Franck Vanhecke, Lebbeke; Esther Basstanie, Zandhoven, both of Belgium

[73] Assignee: Betzdearborn Inc., Trevose, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 09/051,438

[22] PCT Filed: Oct. 15, 1996

[86] PCT No.: PCT/US96/16345

§ 371 Date: Jun. 22, 1998

§ 102(e) Date: Jun. 22, 1998

[87] PCT Pub. No.: WO97/15646

PCT Pub. Date: May 1, 1997

[30] Foreign Application Priority Data

Oct. 24, 1995 [DE] Germany ..... 195 39 523

[51] Int. Cl.[7] ..... B05D 1/00

[52] U.S. Cl. ..... 427/180; 427/384; 106/2

[58] Field of Search ..... 106/2; 427/180, 427/384

[56] References Cited

U.S. PATENT DOCUMENTS 5,225,249 7/1993 Biresaw ..... 427/353

5,300,194 4/1994 Welkener et al. ..... 162/199

FOREIGN PATENT DOCUMENTS

0254274A2 1/1988 European Pat. Off. .

0393749A 10/1990 European Pat. Off. .

0599440A 6/1994 European Pat. Off. .

OTHER PUBLICATIONS

*McGraw–Hill Dictionary of Scientific and Technical Terms*, Third Edition, Copyright 1984, Sybil P.Parker p. 540.

*The Condensed Chemical Dictionary*, Eighth Edition, Copyright 1971, Gessner G. Hawley, p. 265.

*Primary Examiner*—Erma Cameron

*Attorney, Agent, or Firm*—Joanne M. F. Rossi

[57] ABSTRACT

A release agent for rolls, particularly rolls in paper making such as press rolls is described which comprises one or more release active components and optionally conventional additives and which is in the form of a microemulsion. Suitable compositions include those which are essentially free from water and to which water is only added before actual application. The microemulsion or the microemulsion, which upon water dilution is at least intermediately formed, is unstable upon dilution with water to the application concentration which results in a good and homogeneous application of the active ingredients to the press surface. In this way the efficiency of the release agent and the release properties of the rolls are improved. Further, less deposits are formed on the roll surface.

7 Claims, 2 Drawing Sheets

RELEASE FORCE MEASURED ON GREEN GRANITE

RELEASE FORCE MEASURED ON GREEN GRANITE

RELEASE AGENT FOR ROLLS AND METHOD FOR IMPROVING RELEASE PROPERTIES OF ROLLS

CROSS-REFERENCE TO RELATED APPLICATIONS

This application is a national stage of, and claims priority of PCT Application Number PCT/US96/16345 filed Oct. 15, 1996 which claims priority of German Application Number DE 195 39 523.9 file Oct. 24, 1995.

BACKGROUND OF THE INVENTION

The invention relates to a release agent for rolls and to a method for improving the release properties of rolls. In particular, the invention is directed to a release agent for rolls like press rolls in paper making and a method for improving the release properties of such rolls.

In many technical processes, continuous materials like films, webs etc. are passed over rolls. Depending on the conditions (temperature, pressure, moisture content etc.), the continuous material more or less adheres to the roll so that a certain release force is required to remove the continuous materials from the roll. Therefore, such rolls are often treated with release agents to lower said release force and to facilitate removal of the continuous material from the roll. The composition of such release agents differs widely depending on the nature of the continuous material passed over the roll, the material and the surface state of the roll and the processing conditions. Generally speaking, such agents include release active agents, often also called lubricants. Usually such agents are used pure or in form of an emulsion.

A problem often involved in the passing of a continuous material over rolls is that deposits are formed on the surface of the rolls originating from the ingredients or contaminants of the continuous material. Such deposits adversely affect the performance of the rolls and eventually result in stopping the process so that the rolls can be cleaned. To avoid such cleaning or to at least increase the intervals of such cleaning interruptions, deposit preventing agents are used, the composition of which depends on the specific process, but mostly includes a polymeric substance.

Since known release agents and deposit preventing agents are often not fully satisfactory, it is an object of the present invention to provide an improved release agent for rolls and a method using said agent for improving the release properties of rolls. It is a further object of the invention to improve the efficiency of substances used for preventing deposits on rolls.

Thus, the invention relates to a composition in form of a microemulsion which comprises one or more release active components and upon dilution with water is useful as a release agent for press rolls in papermaking systems, which is characterized in that it breaks upon dilution with water.

Further, the invention relates to a composition which comprises one or more release active components, forms a microemulsion upon addition of an appropriate amount of water, and upon further dilution with water is useful as a release agent for press rolls in papermaking systems, which is characterized in that the microemulsion breaks upon dilution with water.

Furthermore, the invention relates to a method for improving the release properties of rolls like press rolls in papermaking, which is characterized by diluting a microemulsion according to the invention with water to break the microemulsion and applying the diluted microamulsion to the roll.

Preferred embodiments and advantages of the invention will become apparent from the following detailed description of the invention and the claims.

DETAILED DESCRIPTION OF THE INVENTION

Figure 1:
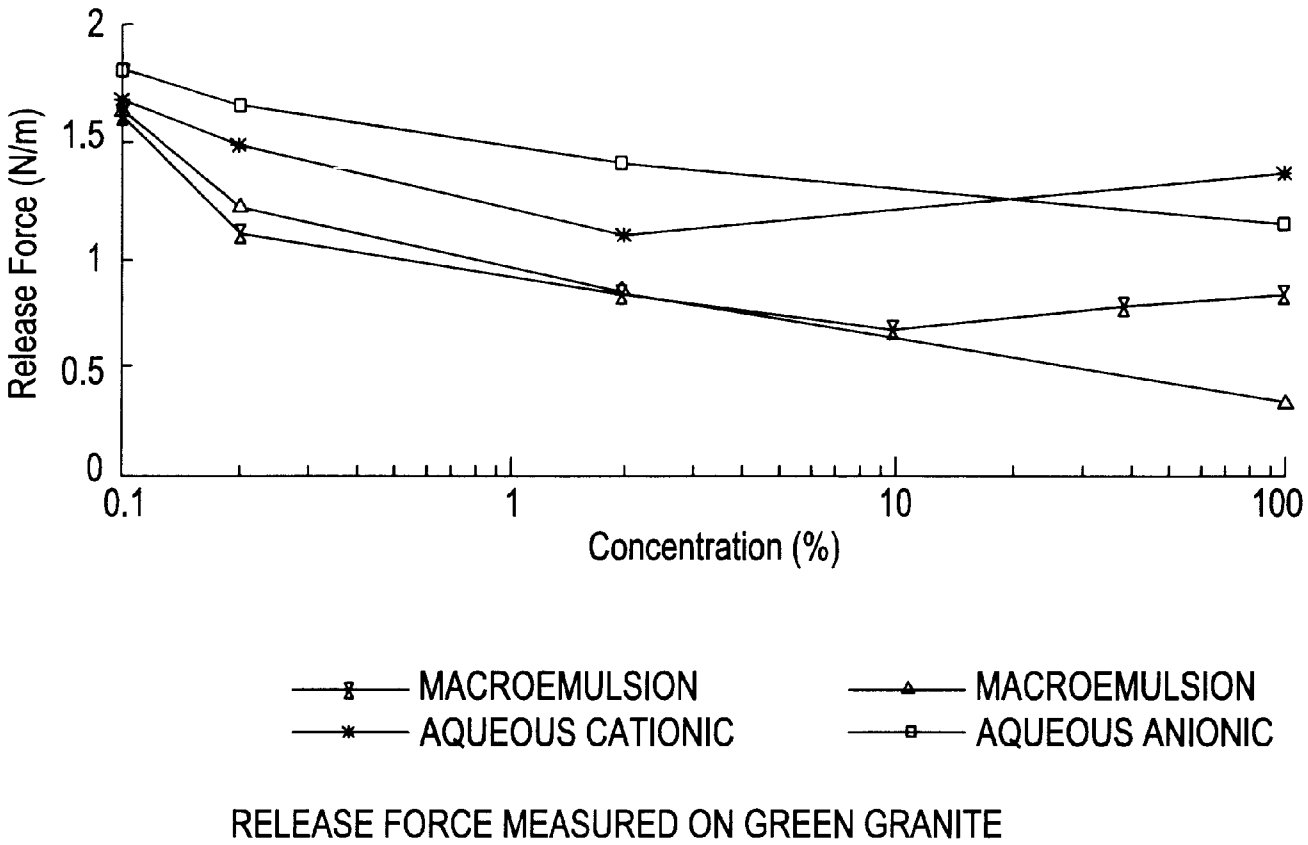
FIG. 1 illustrates the effect of diluting various release agents on the sheet release force as measured in accordance with the test procedure described in Example 1.

While the invention is generally applicable to all kinds of rolls over which a continuous material is passed, the invention is particularly suitable in paper mills and accordingly will be described in the following with particular reference to papermaking and the specific problems involved therein.

Known release active or lubricating agents, which are also useful in the present invention, for rolls in papermaking, particularly press rolls, are oils, water insoluble surfactants, water insoluble polymers and waxes which are applied to the rolls (e.g., by spraying). While some of these release active substances can be applied pure, they are mostly used in the form of an emulsion (macroemulsion) for ease of application and better distribution on the roll surface in combination with smaller amounts of active substance required in comparison to the use of the pure substance. However, it is known that these agents suffer from major organic deposit problems and that they are unable to prevent organic deposits.

It is now surprisingly found that the above problems can be overcome or at least considerably reduced if the release agent is in the form of a microemulsion which is diluted with water prior to the application to the rolls. Microemulsions are transparent dispersions containing particles of less than 100 nm in size and mostly include an oily component, a surfactant, a cosurfactant and water. Sometimes the oily component and the cosurfactant can be the same. Usually microemulsions are of low viscosity. The individual components are present in such quantities that at least at room temperature stable, liquid, single-phase systems are formed. Suitable components for and the preparation of microemulsions as well as the properties of microemulsions are known and extensively described in the literature (see e.g., "Encyclopedia of Emulsion Technology", 1983 by Marcel Dekker, Inc.; "Milton J. Rosen, Surfactants and Interfacial Phenomena", Second Edition, 1989, by John Wiley & Sons, Inc.; and M. Bourrel and R. S. Schlechter, "Microemulsions and Related Systems—Formulation, Solvency and Physical Properties", Surfactant Science Series, Vol. 30, 1988, Marcel Dekker, Inc.).

Without being bound to a theory, it is believed that the improvement relating to the present invention is based on the fact that when diluting known release agents in the form of a macroemulsion, the emulsion droplets containing the release active ingredients are not physically changed, while in contrast microemulsions are only stable when undiluted, and upon dilution become turbid, i.e., the release active ingredients are set free from the solution. In other words, diluting a macroemulsion mainly increases the amount of continuous phase but leaves the stability and thus the tendency of the emulsion droplets to deposit on the roll surface relatively unaffected. In contrast, the particles developing in microemulsions upon dilution have a much greater tendency to deposit on the roll surface. Accordingly, instability of the microemulsion upon dilution is required to obtain the advantages of the present invention.

The present size of the active ingredients in microemulsions obtained upon dilution is similar or preferentially larger than the particle size of corresponding macroemulsions. The larger the particles, the more difficult it is to keep them stable, but the better become the release performance. It would be very difficult to keep a macroemulsion stable (for six (6) months' shelf life) which has a particle size similar to a microemulsion upon dilution. Accordingly, it would be necessary to sufficiently stabilize such macroemulsion by the addition of suitable stabilizers which in turn means that the oily component has a strong tendency to stay in the water phase. So it loses its functions again (see above). In contrast, microemulsions allow a stable six (6) months' shelf life and are triggered to be unstable only when the customer uses it, i.e., upon dilution. If the particle size of the diluted microemulsion is too big (e.g., 150 $\mu$m or more), then the reduced surface coverage is not counterbalancing the improved release anymore since there are not enough particles to cover the surface of the roll (compare Example 4). Thus in general, it is preferred that the microemulsion has a composition that the particles obtained upon dilution have a size in the range of 10 to 150 $\mu$m, preferably 20 to 100 $\mu$m (Coulter Counter, see Example 4).

It was further found that the release agents according to the present invention provide deposit prevention if water soluble polymers are added which are well know for use as deposit inhibiting agents. Particularly suitable are, for example, dicyandiamide-formaldehyde condensates. For a more comprehensive overview of suitable polymers reference is made to EP 0 599 440 A1, the disclosure of which is herewith included by reference.

Besides the release active components and deposit preventing components the release agents according to the present invention can include conventional additives like acid, cleaning surfactants, salt etc., provided they do not adversely affect the stability of the microemulsion and the efficiency of the release active and deposit preventing components.

In the method for improving the release properties of rolls like press rolls in papermaking the microemulsion release agents are diluted with water to break the microemulsion and then the diluted microemulsion is applied to the roll. In practice, the application concentration is usually in the 0.1 to 1.5% by weight and preferably the 0.2 to 1.0% by weight range,. i.e., the microemulsion is diluted with water to such a degree that the composition actually applied to the roll comprises 0.1 to 1.5% by weight and preferably 0.2 to 1.0% by weight of the original microemulsion.

According to an alternative embodiment of the present invention, it is also possible to prepare a release agent which includes all the components described above except for the water. The individual components are present in such quantities that upon addition of water a microemulsion is formed. In other words, this embodiment of the present invention relates to a kind of "concentrate or "potential microemulsion", i.e., it is capable of forming a microemulsion upon the addition of an appropriate amount of water. Since in practice a great excess of water is used (see above), in this embodiment of the invention the microemulsion state is just an intermediate one and the microemulsion is broken immediately so that the release active ingredients are set free. Of course, the addition of water can be stepwise (two or more points of adding water when transporting the release agent to the roll) so that the microemulsion is actually formed and exists for a limited period of time.

The following examples are provided to illustrate the present invention in accordance with the principles of this invention, but are not to be construed as limiting the invention in any way except as indicated in the appended claims. All parts and percentages are by weight unless otherwise indicated.

EXAMPLE 1

The sheet release of release agents in form of a microemulsion, a macroemulsion, an aqueous solution containing a cationic polymer and an aqueous solution containing an anionic polymer was investigated by determining the required release force depending on the degree of dilution. In this test, a freshly prepared wet handsheet is pressed on the sample roll material until a 40% consistency (40% fiber and 60% water) sheet is obtained, which adheres to the surface of the sample roll material. Then the force required to peel off the paper from the sample roll material is measured.

The results are shown in FIG. 1 in which a concentration of 100% designates the undiluted release agent while a concentration of 0.1% designates a composition comprising 99.9% by weight water and 0.1% by weight of the original undiluted release agent.

The macroemulsion consisted of 20% by weight of a modified animal oil, 7.5% by weight of a mixture of two non-ionic surfactants and 72.5% by weight of water. The microemulsion consisted of 8.7% by weight of a modified animal oil, 11.1% by weight of cationic polymer, 13.7% by weight of 2-butoxyethanol, 17.2% by weight of non-ionic surfactant, 1.3% by weight of cationic surfactant and 48% by weight of water. The aqueous solution of the cationic polymer consisted of 2.5% by weight of cationic polymer, 5% by weight of non-ionic surfactant, 0.02% by weight of phosphoric acid and 92.48% by weight of water. The aqueous solution of the anionic polymer consisted of 5% weight of anionic polymer, 10% by weight of a 50% aqueous solution of an anionic surfactant and 85% by weight of water.

It can be seen from FIG. 1 that the release performance is proportionally less by diluting a macroemulsion. By diluting a microemulsion an increase in release performance of a 10% microemulsion compared to the 100% version is observed. Its performance remains substantially constant while further diluting up to about 1%. Thus a small amount of oil performs better in a microemulsion than a large amount of the same oil formulated into a macroemulsion.

EXAMPLE 2

Laboratory and field release tests were performed to compare the microemulsion according to the present invention with conventional aqueous solution and macroemulsion type products. The laboratory release tests were carried out as described in Example 1. in the field release tests the products are applied on the press roll via a spray bar. The point of release of the paper web from the roll is measured in cm. The results are shown in the following table.

| Tested Products | Sheet Release Force(N/m) Field Test at 2000 ppm | Point of Release (cm) Field Test at 8000 ppm |
|---|---|---|
| Blank (water) | 1.80 ± 0.10 | 0 |
| Aqueous cationic I | 1.73 ± 0.02 | 0.5 |
| Aqueous cationic II | 1.47 ± 0.02 | 0.4 |
| Non-ionic macroemulsion | 1.21 ± 0.04 | 0.8 |
| Cationic microemulsion | 1.08 ± 0.04 | 1.5 |

The aqueous cationic I solution was a commercial product and consisted of 20% by weight of cationic polymer, 5% by weight of non-ionic surfactant, 5% by weight of phosphoric acid and 70% by weight of water. Aqueous cationic II was the same product as used in Example 1. The non-ionic macroemulsion consisted of 20% by weight of a modified animal oil, 7.5% by weight of a mixture of two non-ionic surfactants, 1% by weight of cationic surfactant, 2.23% by weight of phosphoric acid and 69.27% by weight of water. The cationic microemulsion according to the invention consisted of 8% by weight of a modified animal oil, 2% by weight of cationic polymer, 19% by weight of non-ionic surfactant, 19% by weight of 2-butoxyethanol and 52% by weight of water.

The best results show that the microemulsion according to the present invention results in the lowest release force. In agreement therewith, it provides the highest point of release.

EXAMPLE 3

Figure 2:
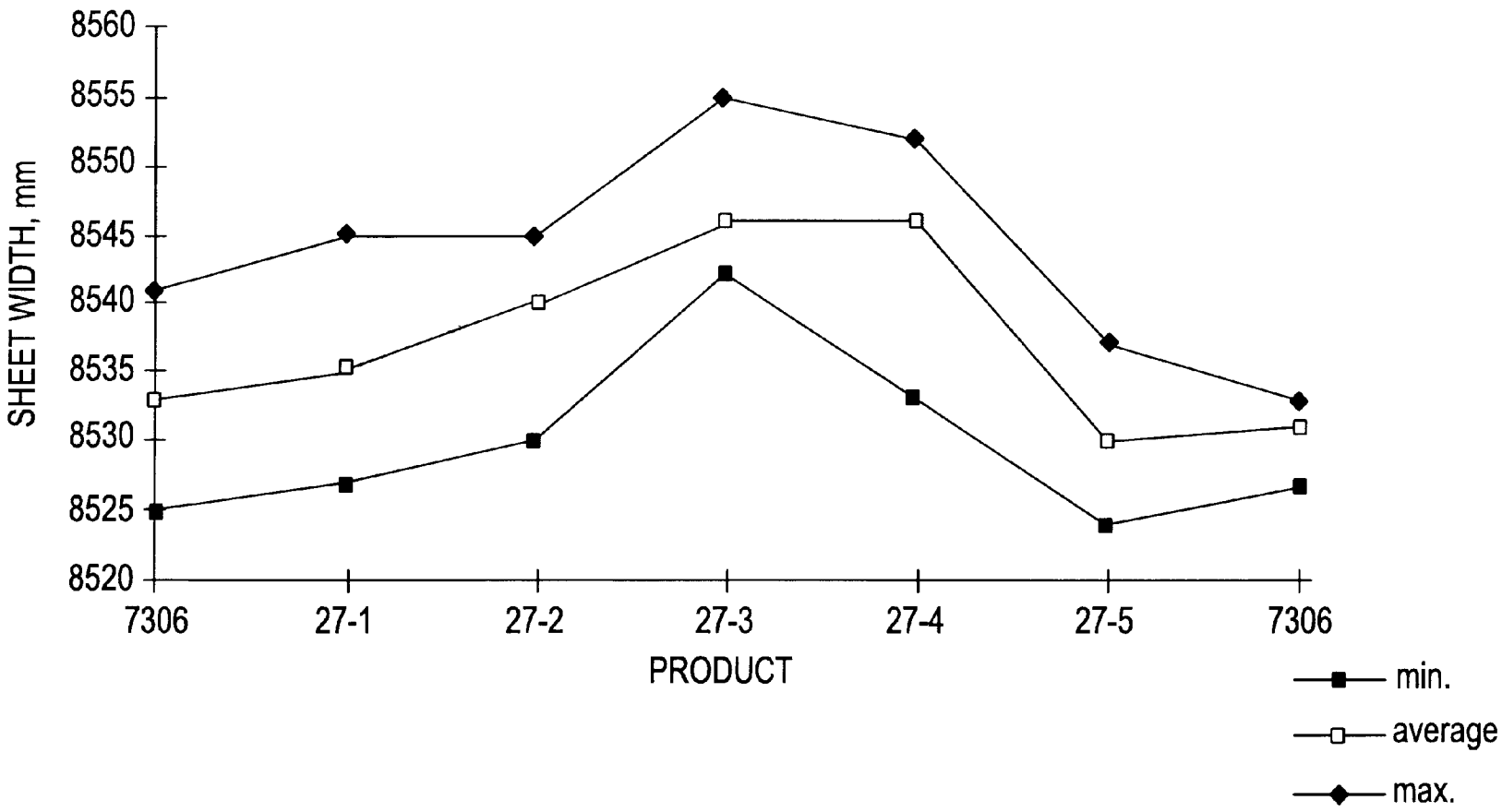
FIG. 2 illustrates the minimum, maximum and average sheet width of paper removed from a press roll when using various release agents in accordance with the test procedure described in Example 3.

In another field trial different microemulsions were tested and compared to conventional aqueous solution and macroemulsion type products. In this test the sheet width of the paper web removed from the press roll was determined. The sheet width decreases with increasing release force required for removing the paper web from the roll. The broader the sheet, the smaller the release force required. The results of the field trial are shown in FIG. 2.

Product 7306 was a commercial product which is an aqueous solution of a cationic polymer and consists of 17.0% by weight of a first cationic polymer, 2% by weight of a second cationic polymer, 0.5% by weight of a cationic surfactant, 5% by weight of phosphoric acid and 75% by weight of water. Product 27-5 was a macroemulsion and consisted of 19.9% by weight of a modified animal oil, 2.49% by weight of a non-ionic surfactant (ethoxylated castor oil, HLB 15), 4.98% by weight of another non-ionic surfactant (ethoxylated fatty acid, HLB 5), 1% by weight of oleyl bis (2-hydroxyethyl)amine, 5.1% by weight of dialkyl ($C_8$–$C_{10}$)dimethyl ammonium chloride, 5.1% by weight of phosphoric acid (85%) and 66.03% by weight of water. Products 27.1 to 27.4 were microemulsions with the following compositions.

27-1: 8% by weight of a modified animal oil, 2% by weight of dicyandiamide-formaldehyde condensate (50% aqueous solution), 20% by weight of ethoxylated (3 EO) $C_{13}$-fatty alcohol, 16.8% by weight of triethylene glycol monobutyl ether, 2% by weight of dialkyl ($C_8$–$C_{10}$)dimethyl ammonium chloride, 0.04% by weight of phosphoric acid (85%) and 51.16% by weight of water.

27-2: 7% by weight of a modified animal oil, 2% by weight of dicyandiamide-formaldehyde condensate, 20% by weight of ethoxylated (3 EO) $C_{13}$-fatty alcohol, 16.8% by weight of triethylene glycol monobutyl ether, 2% by weight of dialkyl(C8–$C_{10}$)dimethyl ammonium chloride, 0.04% by weight of phosphoric acid (85%), 1% by weight of isoparaffin and 51.16% by weight of water.

27-3: 2.01% by weight of a modified animal oil, 1.99% by weight of dicyandiamide-formaldehyde condensate, 19.92% by weight of ethoxylated (3 EO) $C_{13}$-fatty alcohol, 13.94% by weight of triethylene glycol monobutyl ether, 3.78% by weight of dialkyl ($C_8$–$C_{10}$) dimethyl ammonium chloride, 0.02% by weight of phosphoric acid (85%) and 60.34% by weight of water.

27-4: 8% by weight of a modified animal oil, 2% by weight of cationic polymer, 19% by weight of 2-butoxyethanol, 19% by weight of ethoxylated $C_9$–$C_{11}$-alcohol and 52% by weight of water.

The test results shown in FIG. 2 clearly demonstrate that the microemulsions according to the present invention result in a lower contraction of the paper sheet indicating easier removal from the roll due to a lower release force.

EXAMPLE 4

As explained above, it is required that the microemulsion is unstable upon dilution with water for optimal performance. An unstable emulsion performs better than a stable one. The oil droplets are then "ejected" from the water and absorb more strongly on the roll surface. Further, the microemulsion upon dilution has to provide enough particles to cover the surface of the roll. However, the optimum composition for the microemulsion can be easily determined by diluting it with water and measuring the particle size of the turbid composition obtained by dilution.

The test results, (see Example 1 for description of test conditions) summarized in the following table, were obtained by diluting the microemulsions to a concentration of 0.2%, i.e., by adding 99.8% by weight of water. Particle size was determined using a Coulter Counter LS 130. The maximum of the obtained particle size distribution (volume distribution) is given as particle size.

| Microemulsion Containing | Release Force (Blank = 1.90 N/m) | Comment |
|---|---|---|
| 8% oil X/0% A | 1.51 | Clear upon dilution/ no particles |
| 8% oil X/1% A | 1.11 | Turbid upon dilution |
| 8% oil X/20% hydrophobic surfactant/3% A | 0.88 | Turbid upon dilution/ 12 μm particle size |
| 6.7% oil X + 1.3% oil Y 20% hydrophobic surfactant/3% A | 0.82 | Turbid upon dilution/ 32 μm particle size |
| 4% oil X + 4% oil Y 20% hydrophobic surfactant/3% A | 0.84 | Turbid upon dilution/ 116 μm particle size |
| 8% oil Y 20% hydrophobic surfactant/3% A | 0.91 | Turbid upon dilution/ 153 μm particle size |

In the above table, oil X is a modified animal oil, oil Y is an isoparaffin oil, the hydrophobic surfactant is ethoxylated (3 EO) $C_{13}$-fatty alcohol, and A is dialkyl ($C_8$–$C_{10}$)dimethyl ammonium chloride.

As can be seen from the results summarized in the above table, the first microemulsion was too stable and thus did not free the oil particles. Accordingly, it remained clear upon dilution and resulted in a comparatively high release force. The third, fourth, fifth and sixth microemulsion only differ with regard to the composition of the oil component. As can be seen, the lowest release force was measured for the fourth microemulsion providing a particle size of 32 $\mu$m.

We claim:

1. A method for improving the release properties of rolls characterized by the steps of (a) diluting a release agent which is in the form of a microemulsion with water to break the microemulsion and form a composition wherein the composition comprises 98.5 to 99.9% by weight of water and (b) applying said composition to said rolls.

2. The method as claimed in claim 1 wherein said diluted microemulsion comprises 99.0 to 99.8% by weight of water.

3. The method as claimed in claim 1 wherein said release agent contains release active components selected from the group consisting of oils, water insoluble surfactants, water insoluble polymers, waxes, and mixtures thereof.

4. The method as claimed in claim 3 further comprising a deposit preventing component.

5. The method as claimed in claim 4 wherein said deposit preventing component is a water-soluble polymer.

6. The method as claimed in claim 1 wherein said composition contains particles having a size from 10 to 150 $\mu$m.

7. The method as claimed in claim 1 wherein said rolls are press rolls in papermaking systems.

* * * * *